US010895029B2

(12) United States Patent
Shiraishi et al.

(10) Patent No.: US 10,895,029 B2
(45) Date of Patent: Jan. 19, 2021

(54) SEWING MACHINE

(71) Applicant: JUKI CORPORATION, Tama (JP)

(72) Inventors: Atsushi Shiraishi, Tama (JP); Daishi Kuramashi, Tama (JP)

(73) Assignee: JUKI CORPORATION, Tokyo (JP)

( * ) Notice: Subject to any disclaimer, the term of this patent is extended or adjusted under 35 U.S.C. 154(b) by 40 days.

(21) Appl. No.: 16/353,096

(22) Filed: Mar. 14, 2019

(65) Prior Publication Data

US 2019/0292701 A1 Sep. 26, 2019

(30) Foreign Application Priority Data

Mar. 20, 2018 (JP) ..... 2018-052004

(51) Int. Cl.
*D05B 27/04* (2006.01)
*D05B 29/12* (2006.01)

(52) U.S. Cl.
CPC ..... *D05B 27/04* (2013.01); *D05B 29/12* (2013.01)

(58) Field of Classification Search
CPC ..... D05B 27/04; D05B 27/06; D05B 27/08; D05B 27/24; D05B 29/00; D05B 29/02; D05B 29/12
USPC ..... 112/320
See application file for complete search history.

(56) References Cited

U.S. PATENT DOCUMENTS 4,364,318 A * 12/1982 Schneider ..... D05B 27/02 112/147
5,551,361 A * 9/1996 Clapp ..... D05B 29/02 112/235
5,678,502 A * 10/1997 Mulcahey ..... D05B 11/005 112/2.1
7,055,445 B1 * 6/2006 Hintzen ..... D05B 27/04 112/320
2006/0107883 A1 * 5/2006 Terao ..... D05B 19/12 112/237
2007/0266920 A1 * 11/2007 Fujihara ..... D05B 29/12 112/313
2011/0290168 A1 * 12/2011 Kawai ..... D05B 29/12 112/236
2012/0085274 A1 * 4/2012 Bardh ..... D05B 27/04 112/475.01

(Continued)

FOREIGN PATENT DOCUMENTS

JP 2013-52122 A 3/2013

*Primary Examiner* — Alissa L Hoey
*Assistant Examiner* — Patrick J. Lynch
(74) *Attorney, Agent, or Firm* — Faegre Drinker Biddle & Reath LLP

(57) ABSTRACT

A sewing machine includes an upper feed mechanism, a presser foot mechanism and a control device. The upper feed mechanism feeds a workpiece on a throat plate from above by an upper feed dog. The presser foot mechanism includes a presser foot for pressing the workpiece on the throat plate from above. The control device controls a driving source of the presser foot mechanism. The upper feed mechanism supports the upper feed dog to be vertically movable between an upper retreat position and a lower feed position. The upper feed mechanism includes a detection unit that detects a downward movement of the upper feed dog from the retreat position. The control device controls the driving source to pull the presser foot upward by a detection of the detection unit.

6 Claims, 11 Drawing Sheets

(56) References Cited

U.S. PATENT DOCUMENTS

| | | | | |
|---|---|---|---|---|
| 2014/0000499 | A1* | 1/2014 | Kato | D05B 27/04<br>112/470.06 |
| 2016/0258093 | A1* | 9/2016 | Koike | D05B 19/12 |
| 2017/0073865 | A1* | 3/2017 | Kuramashi | D05B 29/02 |

* cited by examiner

SEWING MACHINE

CROSS-REFERENCE TO RELATED APPLICATIONS

The present application claims priority from Japanese Patent Application No. 2018-052004, filed Mar. 20, 2018, the entire content of which is incorporated herein by reference.

TECHNICAL FIELD

The present invention relates to a sewing machine including an upper feed.

BACKGROUND ART

In the related art, a sewing machine equipped with an upper feed mechanism having an upper feed dog capable of position switching between an upper retreat position and a lower feed position has been used in order to perform upper feed as necessary.

The upper feed mechanism of the sewing machine includes the upper feed dog, a feed motion mechanism which imparts a reciprocating motion along a cloth feeding direction to the upper feed dog, and a vertical motion mechanism which imparts a reciprocating motion along an up-down direction to the upper feed dog.

In addition, the upper feed dog is movable between the upper retreat position and the feed position, and when the upper feed dog is not in use, the upper feed dog is disposed in the retreat position and is moved downward to the feed position during the use (refer to, for example, Japanese Unexamined Patent Application Publication No. 2013-052122).

However, when the upper feed mechanism of the sewing machine in the related art sets the upper feed dog to the feed position, and when the presser foot is in a state of being lowered, the presser foot hinders the upper feed dog so that it was not possible to dispose the upper feed dog in the feed position.

Therefore, in the case of setting the upper feed dog to the feed position, the presser foot has to be pulled upward in advance, which is complicated and a burden of work.

SUMMARY

An object of the present invention is to make switching work of an upper feed dog to a feed position easy.

A sewing machine includes an upper feed mechanism, a presser foot mechanism and a control device. The upper feed mechanism feeds a workpiece on a throat plate from above by an upper feed dog. The presser foot mechanism includes a presser foot for pressing the workpiece on the throat plate from above. The control device controls a driving source of the presser foot mechanism. The upper feed mechanism supports the upper feed dog to be vertically movable between an upper retreat position and a lower feed position. The upper feed mechanism includes a detection unit that detects a downward movement of the upper feed dog from the retreat position. The control device controls the driving source to pull the presser foot upward by a detection of the detection unit.

The upper feed mechanism may include a supporting member that supports the upper feed dog to be vertically movable between the retreat position and the feed position, and a rattling preventing spring that biases the upper feed dog upward. The supporting member may hold the upper feed dog at the feed position by a structure of unevenness between the supporting member and the upper feed dog.

The supporting member may have a long slot that supports the upper feed dog to be vertically movable between the retreat position and the feed position. The long slot may be formed in a shape bent at a lower end portion.

The supporting member may be supported to be vertically movable. A lower end portion of the supporting member may be supported to be swingable along a cloth feeding direction, in a sewing machine arm portion.

The configuration of the present invention controls the driving source of the presser foot mechanism and controls the presser foot to move upward when detecting the downward movement of the upper feed dog, and thus, it becomes possible to reduce a workload when a user switches the upper feed dog to the feed position.

DETAILED DESCRIPTION OF EMBODIMENTS

Outline of Embodiments

Figure 1:
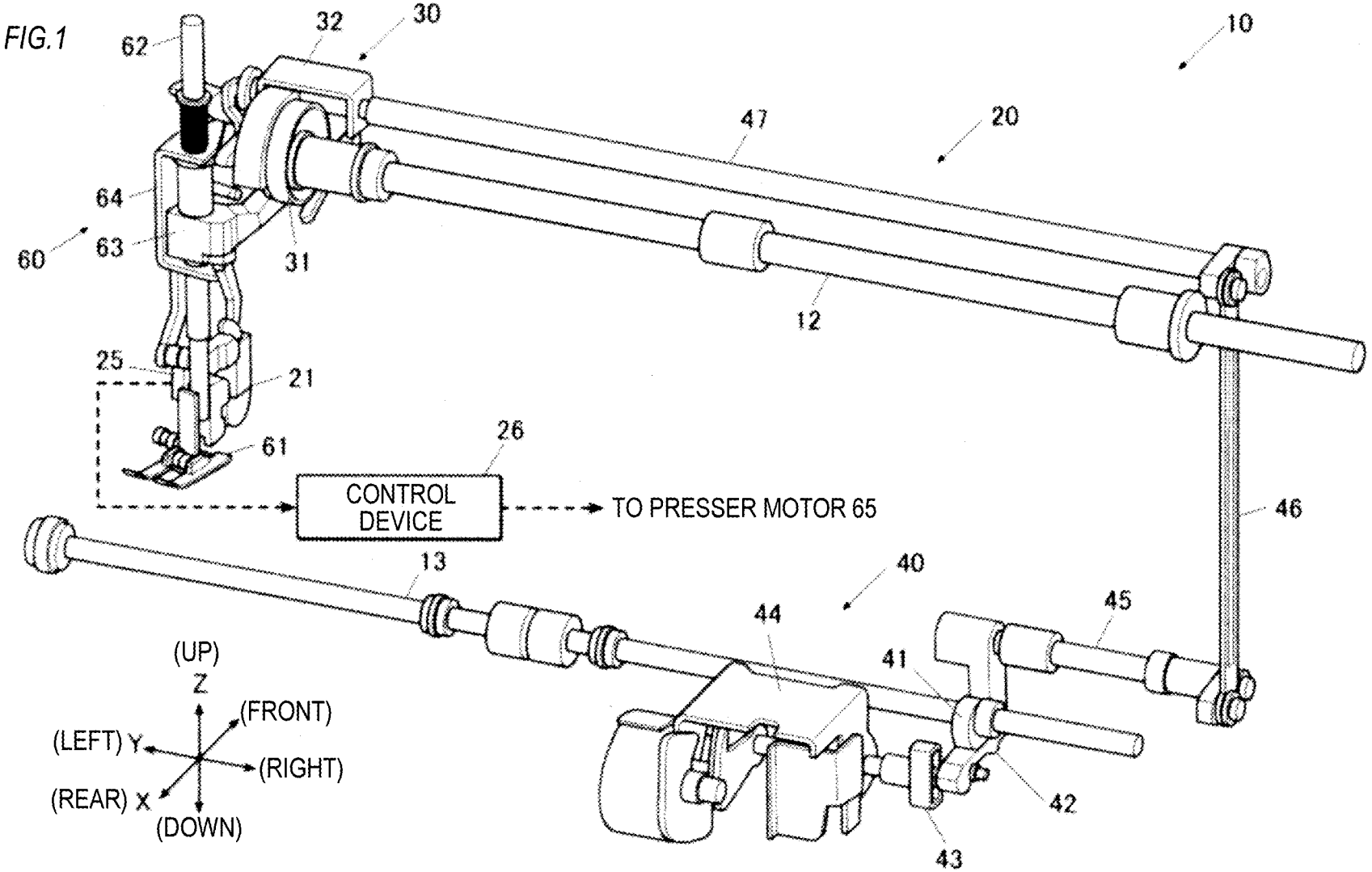
FIG. 1 is a perspective view illustrating main parts of an inner configuration of a sewing machine according to an embodiment of the present invention.

Hereinafter, a sewing machine according to the present invention will be described with reference to the drawings. FIG. 1 is a perspective view illustrating main parts of an inner configuration of a sewing machine 10.

The sewing machine 10 includes an upper shaft 12 which is rotatably driven by a sewing machine motor (not illustrated), a lower shaft 13 which is rotatably driven by a rotating force transmitted from the upper shaft 12, an upper feed mechanism 20 which feeds a workpiece (not illustrated) on a throat plate 11 by an upper feed dog 21 from above, a presser foot mechanism 60 having a presser foot 61 for pressing the workpiece on the throat plate 11 from above, a main feed mechanism that feeds the workpiece on the throat plate to the upper feed dog from below, and a control device 26.

In addition, the sewing machine 10 includes the main feed mechanism, a needle bar vertical motion mechanism which vertically moves a needle bar having a sewing needle, a shuttle mechanism (or looper mechanism) for trapping an upper thread from the sewing needle and for making the upper thread pass through a loop of the lower thread, a thread take-up lever mechanism for pulling up the upper thread, a thread tensioner for imparting tension to the upper thread, a sewing machine frame for storing and saving each configuration of the sewing machine, and the like, but all of the mechanisms are known configurations, and thus, the description thereof will be omitted.

In addition, in the following description, it is assumed that a horizontal cloth feeding direction in which the workpiece is fed is an X-axis direction, a direction orthogonal to the horizontal cloth feeding direction is a Y-axis direction, and a vertical up-down direction is a Z-axis direction. In addition, in the X-axis direction, the downstream side in the cloth feeding direction is defined as "front", and the opposite side as "rear". Further, in the Y-axis direction, the left side in a state of being oriented forward is defined as "left", and the right side as "right". In addition, in the Z-axis direction, the vertically upper side is defined as "upper" and the lower side as "lower".

(Upper Shaft and Lower Shaft)

As illustrated in FIG. 1, the upper shaft 12 is rotatably supported in a sewing machine arm portion along the Y-axis direction. The upper shaft 12 is rotationally driven by a sewing machine motor (not illustrated).

The lower shaft 13 is rotatably supported in a sewing machine bed portion along the Y-axis direction.

From the upper shaft 12 to the lower shaft 13, for example, rotating force is transmitted by a belt mechanism (not illustrated) or a bevel gear mechanism using a longitudinal shaft (not illustrated).

(Presser Foot Mechanism)

Figure 2:
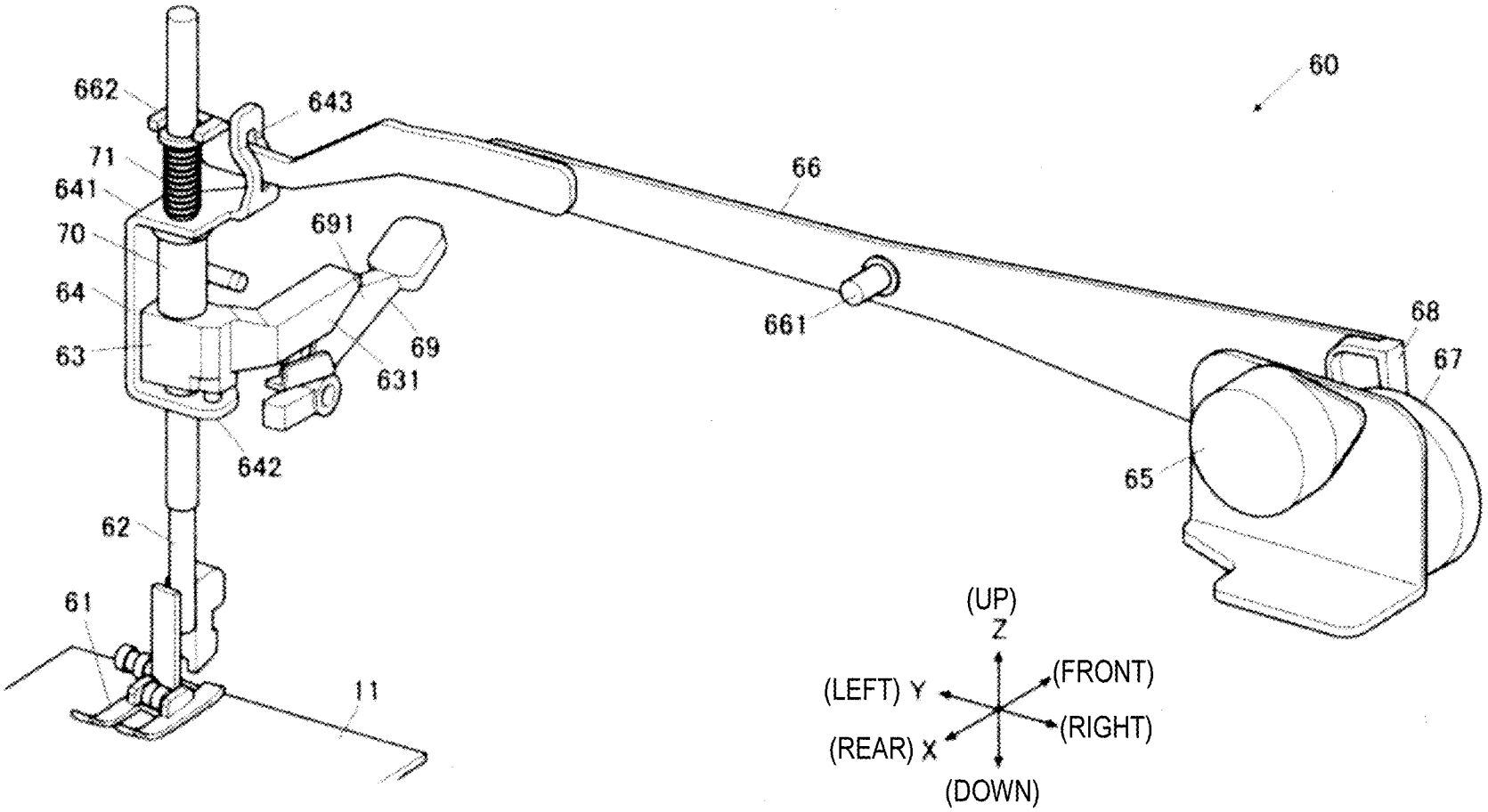
FIG. 2 is a perspective view of a presser foot mechanism.

FIG. 2 is a perspective view of the presser foot mechanism 60.

The presser foot mechanism 60 includes a presser foot 61 for pressing the workpiece from above, a presser bar 62 for holding the presser foot 61 with a lower end portion, a bar holder 63 fixedly installed in the middle of the presser bar 62, a feed dog bracket 64 provided on the presser bar 62 in a state where the presser bar 62 penetrates the feed dog bracket 64, a feed motor 65 that serves as a driving source for a raising and lowering operation of the presser foot 61, a lever-like presser lifting rod 66 that acquires power from the feed motor 65 and raises and lowers the feed dog bracket 64, a presser lifting gear 67 that decelerates the rotation of the feed motor 65, a fan-like gear 68 that is provided in the presser lifting rod 66 and meshes with the presser lifting gear 67, and a presser lifting lever 69 for pulling up the presser foot 61 upward by a manual rotation operation.

Most of the configuration of the presser foot mechanism 60 is stored on the inside of the sewing machine arm portion of a sewing machine frame, and only the presser foot 61, the lower portion of the presser bar 62, and the tip end of the presser lifting lever 69 are exposed to the outside.

The presser foot 61 is a so-called boat-like presser foot, and a cutout is formed in a front end portion. The upper feed dog 21 which will be described later inserts a tip end portion thereof into the cutout of the presser foot 61 and feeds the tip end portion being in contact with the workpiece from above.

The presser bar 62 is in a form of a round bar, and is supported by the sewing machine sewing machine arm portion in a state where a longitudinal direction thereof is along the Z-axis direction and in a state where the presser bar 62 is slidable along the Z-axis direction.

In addition, the presser bar 62 is pressed downward by a presser spring 71 which will be described later, and a pressurizing force of the presser spring 71 becomes a pressing pressure of the presser foot 61.

The bar holder 63 is hugged and fixed in an intermediate portion in the up-down direction of the presser bar 62 on the inside of the sewing machine arm portion. The bar holder 63 is provided with a protrusion 631 that extends toward the presser lifting lever 69 side (front side).

One end portion of the presser lifting lever 69 is rotatably supported around the Y-axis in the sewing machine arm portion, and the other end portion extends to the front part on the outside of the sewing machine arm portion.

In addition, a cam portion 691 which abuts against a lower surface of the protrusion 631 of the bar holder 63 is formed on the presser lifting lever 69. Further, when the other end portion of the presser lifting lever 69 is manually rotated upwardly, the cam portion 691 can push the protrusion 631 of the bar holder 63 upward and can press the presser foot 61 to an upper cloth release position against the above-described presser spring.

The feed dog bracket 64 is a U-shaped frame body, and has a pair of opposing flat surface portions 641 and 642 along an X-Y plane on upper and lower sides. In addition, a through-hole is formed in each of the pair of flat surface portions 641 and 642, and the presser bar 62 is inserted in a state of hugging the bar holder 63 between the pair of flat surface portions 641 and 642.

A vertical distance between the pair of flat surface portions 641 and 642 is wider than the vertical width of the bar holder 63, and a cylindrical bush 70 is interposed between the upper flat surface portion 641 and the bar holder 63. In addition, the vertical length of the bush 70 is shorter than the width obtained by subtracting the vertical width of the bar holder 63 from the vertical distance between the pair of flat surface portions 641 and 642, and slightly the feed dog bracket 64 can vertically move with respect to the bar holder 63.

Furthermore, a long slot 643 along the up-down direction is formed in the upper flat surface portion 641 of the feed dog bracket 64. One end portion of the presser lifting rod 66 is inserted into the long slot 643 and the feed dog bracket 64 is pulled up by the upward swinging of the one end portion of the presser lifting rod 66, the lower flat surface portion 642 of the feed dog bracket 64 abuts the bar holder 63, and the presser bar 62 and the presser foot 61 can be pulled upward.

In addition, the long slot 643 is vertically longer than the vertical width of the one end portion of the presser lifting rod 66, and the feed dog bracket 64 can somewhat vertically move with respect to the presser lifting rod 66.

The feed motor 65 is supported in a state where an output shaft thereof is oriented in the X-axis direction on the inside of an vertical drum portion of the sewing machine frame.

The feed motor 65 is a stepping motor, and it is possible to control a rotation amount thereof arbitrarily. In addition, the output shaft of the feed motor 65 is equipped with a small gear (not illustrated).

In the presser lifting gear 67, a large gear having a large number of teeth and a small gear having a small number of teeth are concentrically integrated with each other and the large gear meshes with the small gear provided on the output shaft of the feed motor 65.

Furthermore, the small gear of the presser lifting gear 67 meshes with the fan-like gear 68 having a sufficiently larger pitch diameter than that of the small gear.

Accordingly, the presser lifting gear 67 decelerates the output rotation of the feed motor 65 in two stages and transmits the output rotation to the fan-like gear 68.

The presser lifting rod 66 is an elongated member disposed along the Y-axis direction and is supported by a support shaft 661 provided in the intermediate portion in the longitudinal direction such that both end portions thereof can swing on the inside of the sewing machine arm portion.

The support shaft 661 is along the X-axis direction, and accordingly, both end portions of the presser lifting rod 66 can swing up and down.

One end portion of the presser lifting rod 66 is loosely inserted into the long slot 643 of the feed dog bracket 64 as described above, and further, a bifurcated portion 662 having a semi-elliptical cutout shape is formed at the tip end portion thereof. The presser bar 62 is loosely inserted into the bifurcated portion 662, and a compression spring 71 is interposed between the bifurcated portion 662 and the flat surface portion 641 on the upper side of the feed dog bracket 64.

The compression spring 71 presses the bar holder 63 downward from the flat surface portion 641 via the bush 70 to impart the pressing pressure to the presser foot 61.

In addition, the fan-like gear 68 is provided on the other end portion of the presser lifting rod 66 as described above, and the fan-like gear 68 meshes with the presser lifting rod 67. Therefore, by driving the feed motor 65, the swinging motion is imparted to the presser lifting rod 66, and by swinging a left end portion of the presser lifting rod 66 downward, the bifurcated portion 662 compresses the compression spring 71, the presser foot 61 imparts the pressing pressure for pressing the workpiece on the throat plate 11 from above, and it becomes possible to adjust the pressing pressure according to the driving amount of the feed motor 65 (pressing position). In addition, by driving the feed motor 65 to swing the left end portion of the presser lifting rod 66 upward, it is possible to pull the feed dog bracket 64 upward via the long slot 643 to pull up the presser foot 61 via the bar holder 63 to the upper cloth release position.

(Upper Feed Mechanism)

As illustrated in FIG. 1, the upper feed mechanism 20 includes the upper feed dog 21 that is in contact with the workpiece on the throat plate from above and feeds the workpiece along the X-axis direction, the supporting member 22 that supports the upper feed dog 21 to be vertically movable between the upper retreat position and the lower feed position, an upper feed vertical motion mechanism 30 that imparts the vertical motion to the upper feed dog 21, and an upper feed horizontal motion mechanism 40 that imparts a reciprocating motion in the feeding direction to the upper feed dog 21.

In addition, the feed position of the upper feed dog 21 is a position at which the feed motion is performed with respect to the workpiece on the throat plate 11. The retreat position is a position which is separated from the throat plate 11 upward and in which the feed motion is not performed.

(Upper Feed Dog)

Figure 3:
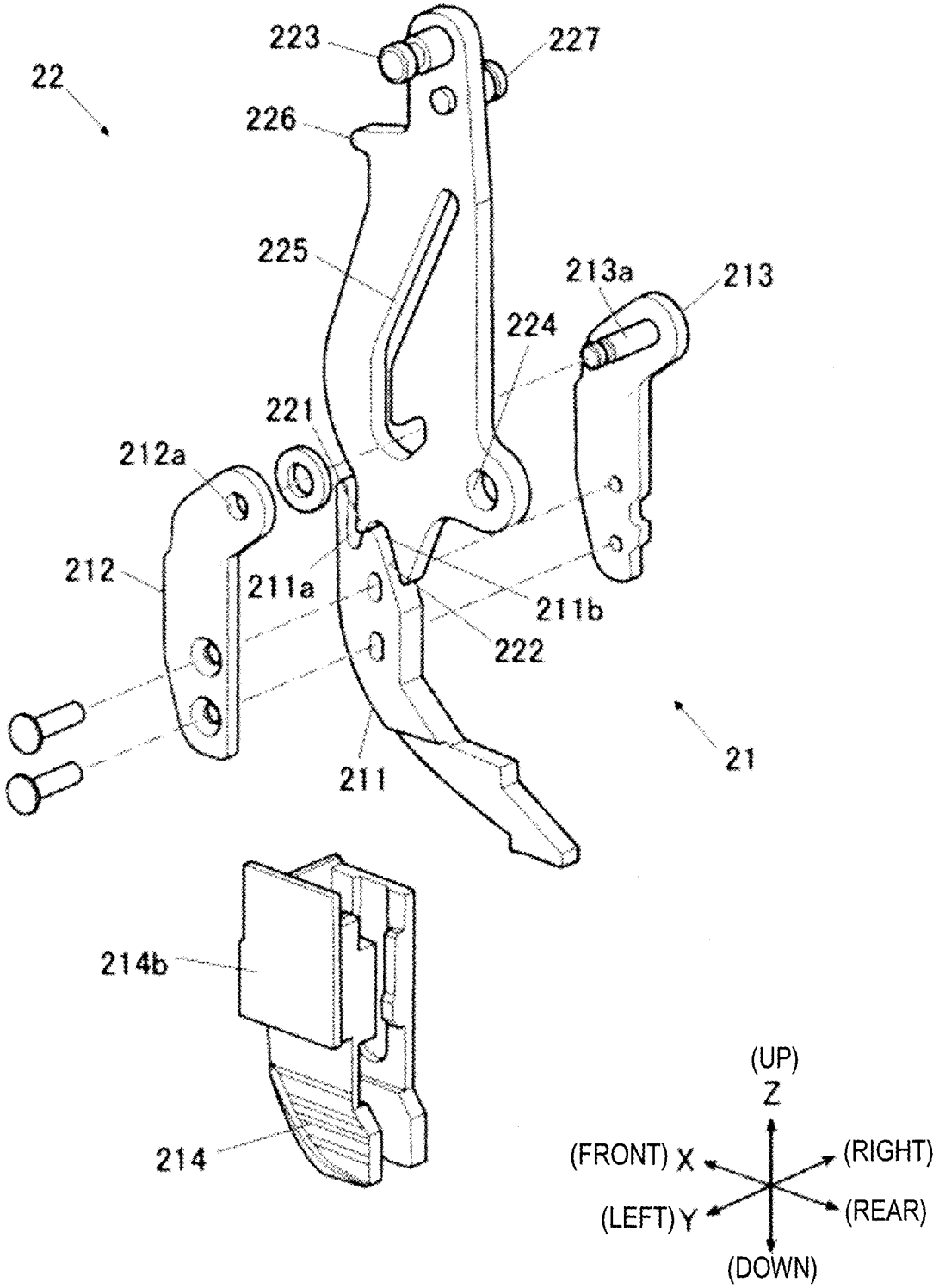
FIG. 3 is an exploded perspective view of an upper feed dog and a supporting member.
Figure 4:
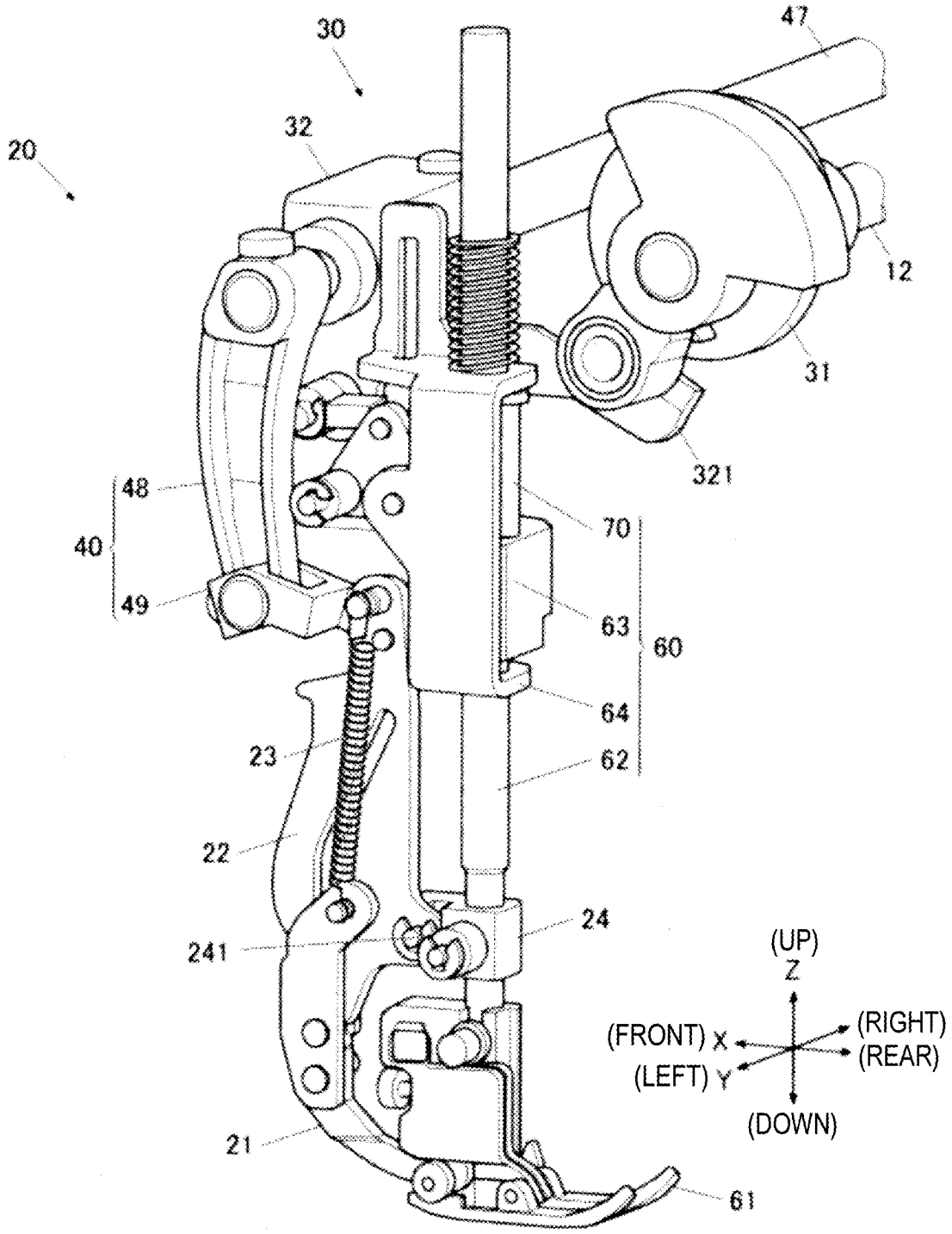
FIG. 4 is a perspective view in which a partial configuration of the upper feed mechanism is not illustrated.
Figure 5:
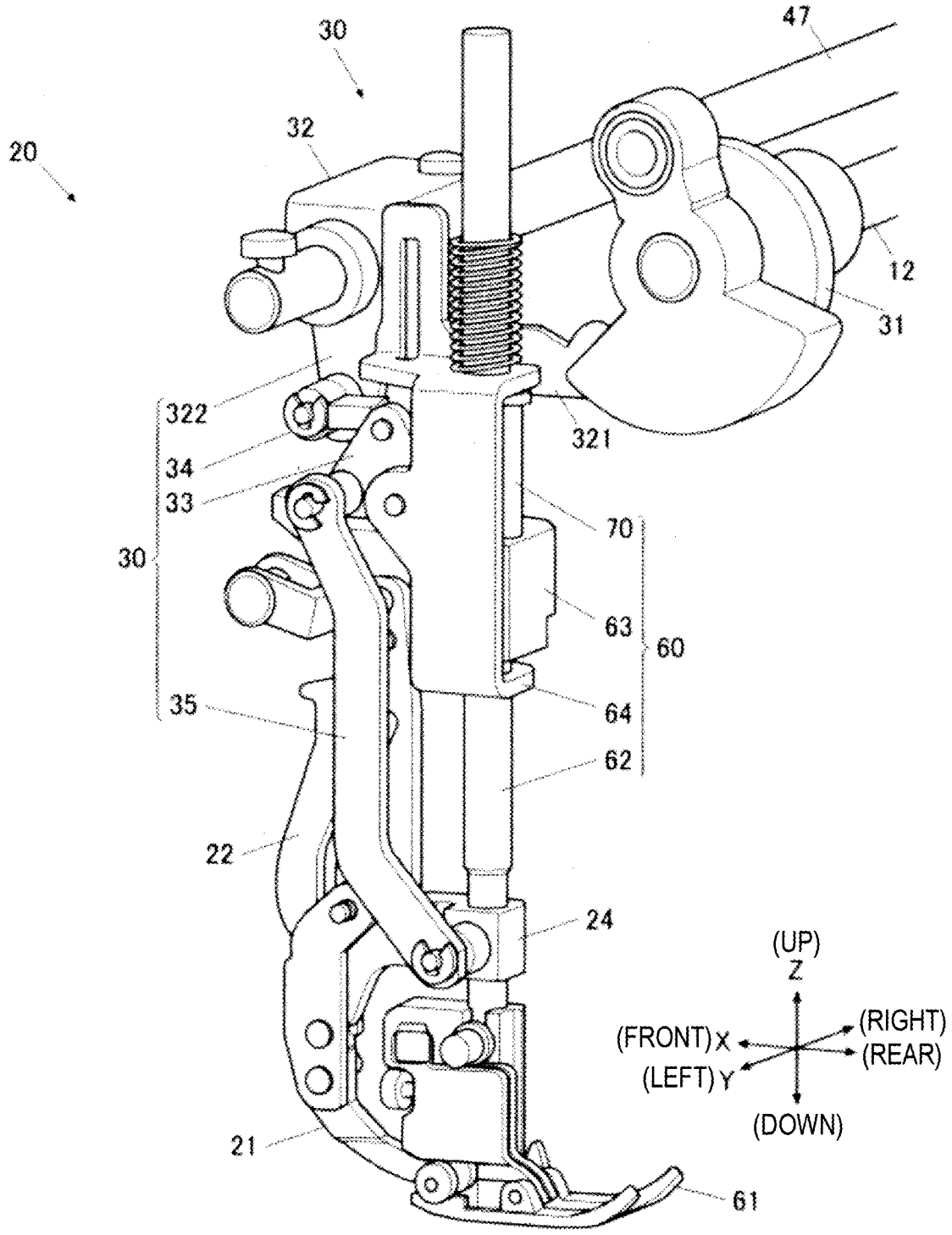
FIG. 5 is a perspective view in which a partial configuration of the upper feed mechanism is not illustrated.
Figure 6:
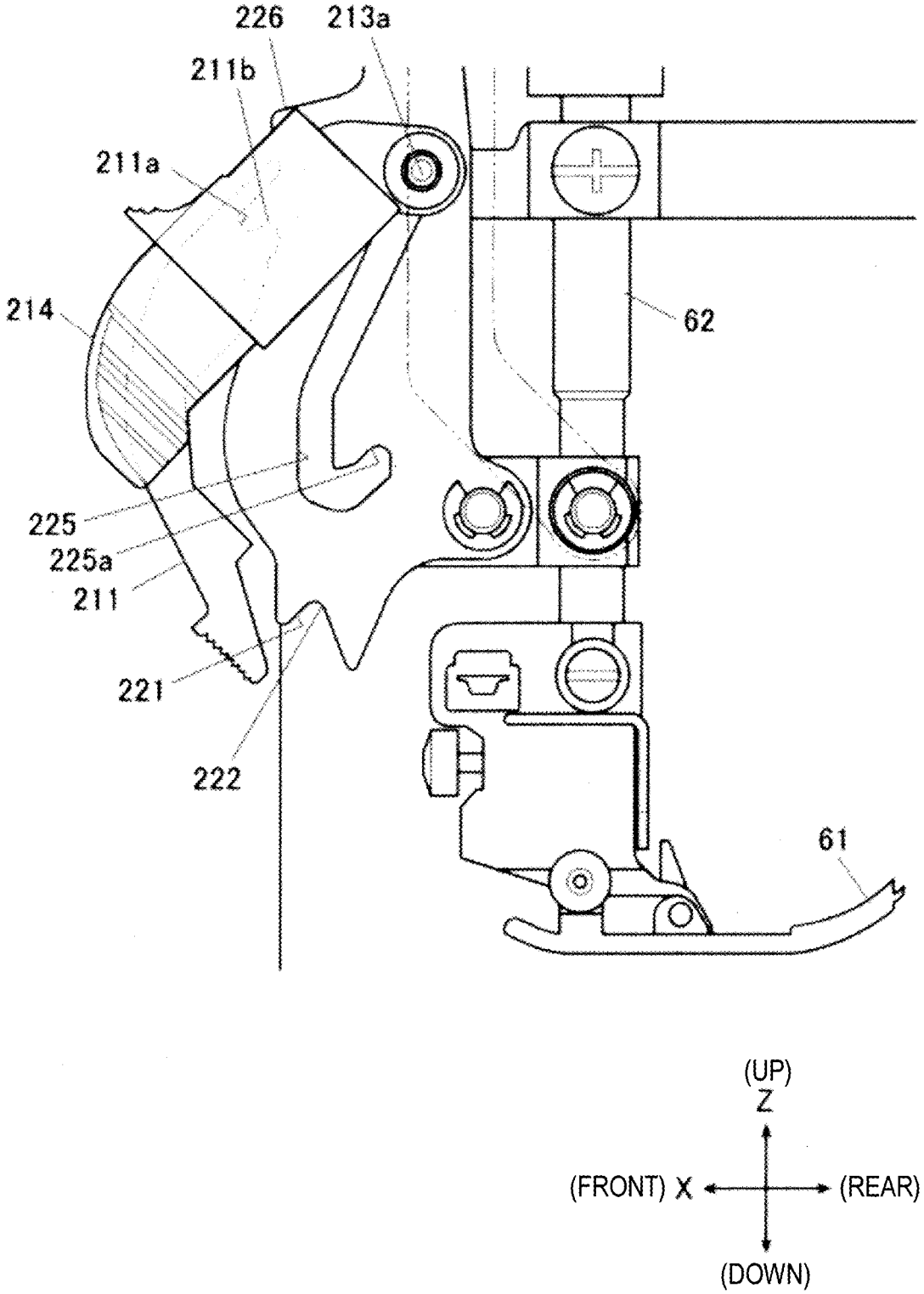
FIG. 6 is a side view in a case where the upper feed dog is in a retreat position.
Figure 7:
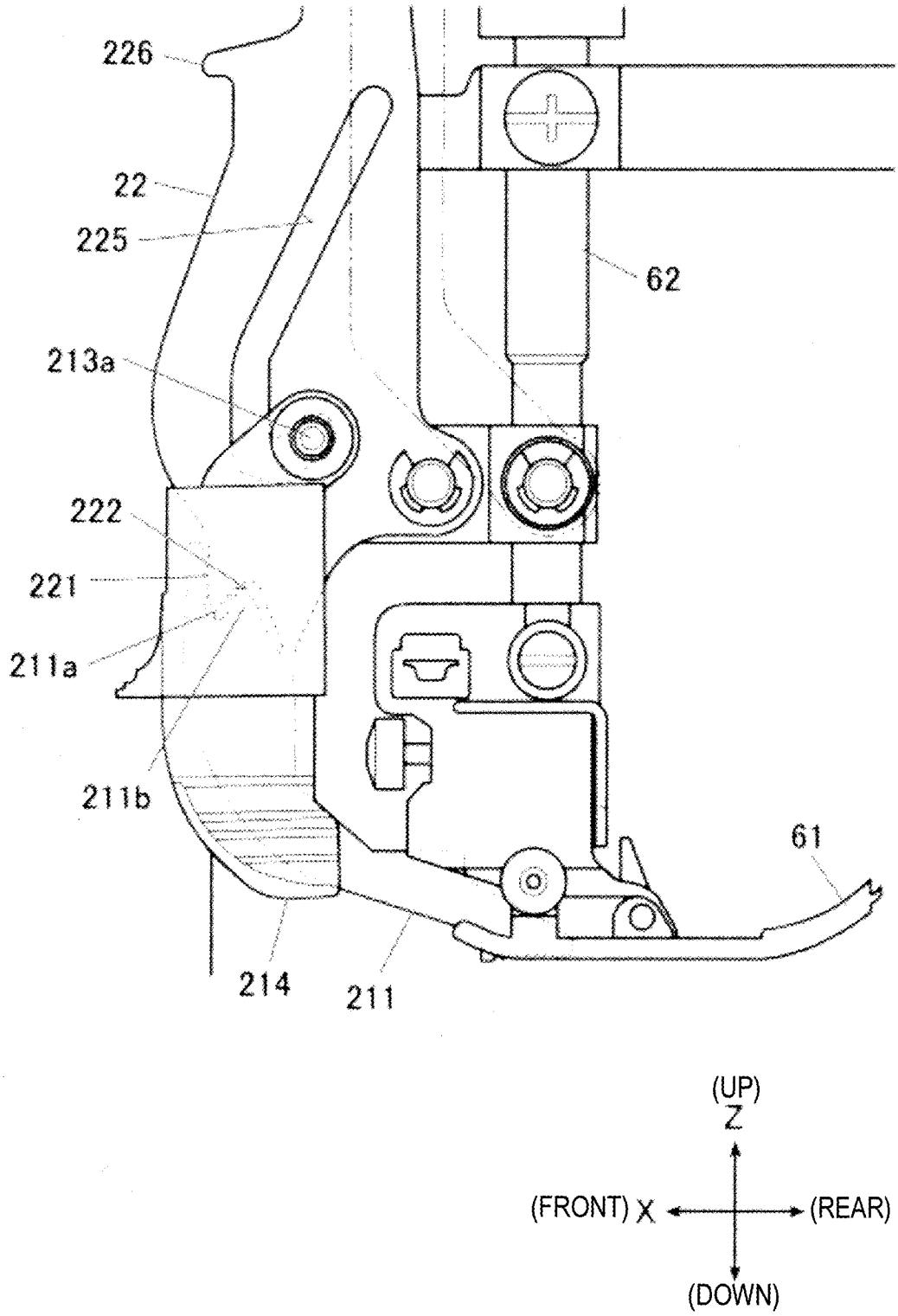
FIG. 7 is a side view in a case where the upper feed dog is in a feed position.

FIG. 3 is an exploded perspective view of the upper feed dog 21 and the supporting member 22, FIG. 4 is a perspective view in which a partial configuration of the upper feed mechanism 20 is not illustrated, FIG. 5 is a perspective view in which a partial configuration of the upper feed mechanism 20 is not illustrated, FIG. 6 is a side view in a case where the upper feed dog 21 is in the retreat position, and FIG. 7 is a side view in a case where the upper feed dog 21 is in the feed position.

As illustrated in FIG. 3, the upper feed dog 21 includes an upper feed dog main body 211, a pair of left and right connecting plates 212 and 213 for connecting the feed dog main body 211 to the supporting member, and a cover body 214.

In the upper feed dog main body 211, the lower end portion is in a wedge shape and a serration-like tooth tip is formed in the bottom thereof, and the tooth tip abuts against the workpiece from above and performs the feeding.

In addition, a recess portion 211*a* and a projection portion 211*b* are formed in parallel back and forth in the upper end portion of the upper feed dog main body 211 and are engaged with a projection portion 221 and a recess portion 222 formed in parallel back and forth in the lower end portion of the supporting member 22, and it is possible to hold the feed dog 21 in the feed position.

The lower end portion of the pair of left and right connecting plates 212 and 213 is fixed to the upper feed dog main body 211 by screwing so as to sandwich the upper feed dog main body 211 from the left and right sides.

In addition, the upper end portions of the pair of left and right connecting plates 212 and 213 are connected to the supporting member 22 by a connecting pin 213*a* provided on the connecting plate 213 in a state where the plate-like supporting member 22 is sandwiched from the left and right sides.

The connecting pin 213*a* of the connecting plate 213 has a round bar shape and extends leftward along the Y-axis direction. In the connecting plate 212, an insertion hole 212*a* through which the connecting pin 213*a* is inserted is formed.

In addition, the connecting pin 213*a* is sufficiently long and protrudes to the left of the connecting plate 212 in a state where the pair of connecting plates 212 and 213 is fixed to the upper feed dog main body 211. In addition, the protruding end portion is connected to the lower end portion of a rattling preventing spring 23 for biasing the upper feed dog 21 upward (refer to FIG. 4). Further, the upper end portion of the rattling preventing spring 23 is connected to a pin 223 provided on the upper end portion of the supporting member 22.

The cover body 214 can be mounted from below, on the upper feed dog main body 211 to which the pair of connecting plates 212 and 213 are fixed, and at the time of mounting, the cover body 214 covers both the left and right surfaces of the upper feed dog main body 211.

Figure 10:
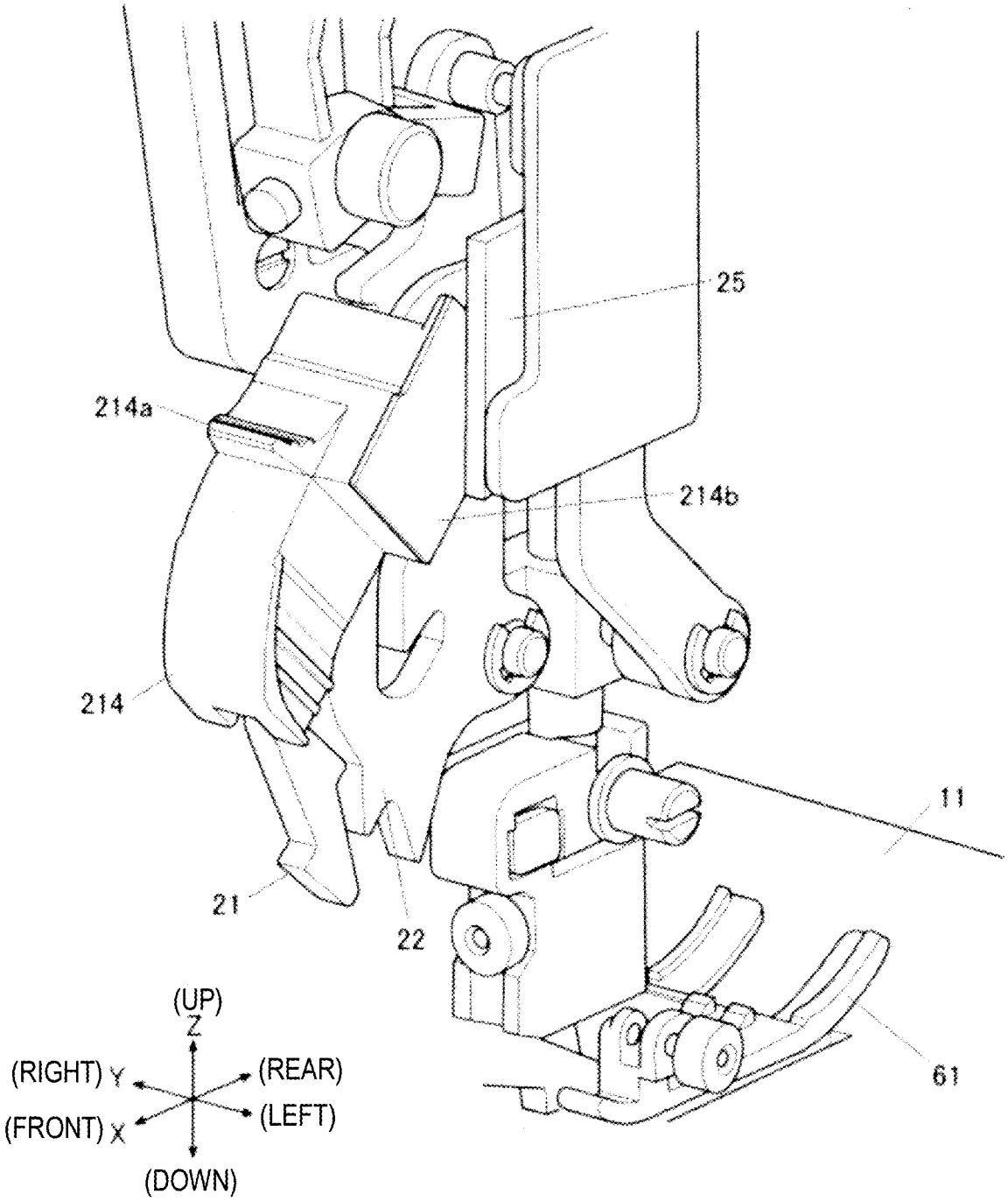
FIG. 10 is a perspective view of a periphery of a presser foot in a case where the upper feed dog is positioned in the retreat position.

On the front side of the cover body 214, a knob 214*a* for moving the upper feed dog 21 between the retreat position and the feed position by the manual operation is formed (refer to FIG. 10).

In addition, on the left side of the cover body 214, a smooth detected surface 214*b* is formed along an X-Z plane. The detected surface 214*b* is detected by an optical proximity sensor 25 (refer to FIG. 10) which will be described later in a case where the upper feed dog 21 is positioned in the retreat position.

(Supporting Member)

As illustrated in FIG. 3, the supporting member 22 has a flat plate along the X-Z plane, the projection portion 221 and the recess portion 222 described above are formed on the lower end portion thereof, and the above-described pin 223 is provided to be projected leftward on the left side at the upper end portion.

In addition, a support hole 224 that is open along the Y-axis direction is formed in the vicinity of the lower end portion of the supporting member 22. The supporting member 22 is rotatably supported to be swingable by a support shaft 241 along the Y-axis direction in a slider 24 through the support hole 224, the support shaft 241 provided in the vicinity of the lower end portion of the presser bar 62 (refer to FIG. 4).

In addition, the slider 24 is slidable along the presser bar 62. Therefore, the supporting member 22 is vertically movable via the slider 24 and is swingable around Y-axis by the support shaft 241 of the slider 24.

In addition, in the supporting member 22, a long slot 225 open in the Y-axis direction is formed along the up-down direction. The long slot 225 has a shape in which the lower end portion is bent upward. In the long slot 225, the connecting pin 213*a* of the upper feed dog 21 is inserted to guide the upper feed dog 21 to vertically move between the retreat position and feed position.

In addition, when the upper feed dog 21 vertically moves, the upper end portion of the upper feed dog main body 211 slides along an outer edge portion on the front side of the supporting member 22.

In other words, the upper feed dog 21 is supported by the supporting member 22 at two points of the upper end portion and the connecting pin 213*a*.

In addition, at the upper end portion of the outer edge portion on the front side of the supporting member 22, a projection-like stopper 226 that protrudes forward is formed and stops the supporting member 22 at the retreat position in a case where the upper feed dog 21 moves upward.

In addition, in a case where the upper feed dog 21 moves downward, the recess portion 211*a* and the projection portion 211*b* of the upper feed dog 21 are engaged with the projection portion 221 and the recess portion 222 of the supporting member 22.

At this time, the connecting pin 213*a* of the upper feed dog 21 is lowered along the long slot 225, is engaged with a part 225*a* which has an upwardly recessed shape formed by the bent portion, and is held in a state of being pressed upward by the tension of the rattling preventing spring 23. Therefore, at the feed position, the upper feed dog 21 is supported at a plurality of positions by the engaging position of the recess portion 211*a* and the projection portion 211*b*, and the engaging position of the connecting pin 213*a*, and are firmly held so as not to cause shaking at the posture thereof.

In addition, a connecting shaft 227 that protrudes to the right is formed in the vicinity of the upper end portion of the right surface of the supporting member 22. The connecting shaft 227 is connected to the upper feed horizontal motion mechanism 40, and the reciprocating motion in a front-rear direction is input into the supporting member 22. Due to the input of the reciprocating motion in the front-rear direction, the supporting member 22 swings around the support shaft 241 of the slider 24, and the reciprocating motion in the front-rear direction is imparted to the upper feed dog 21 held in the feed position.

(Upper Feed Vertical Motion Mechanism)

Figure 8:
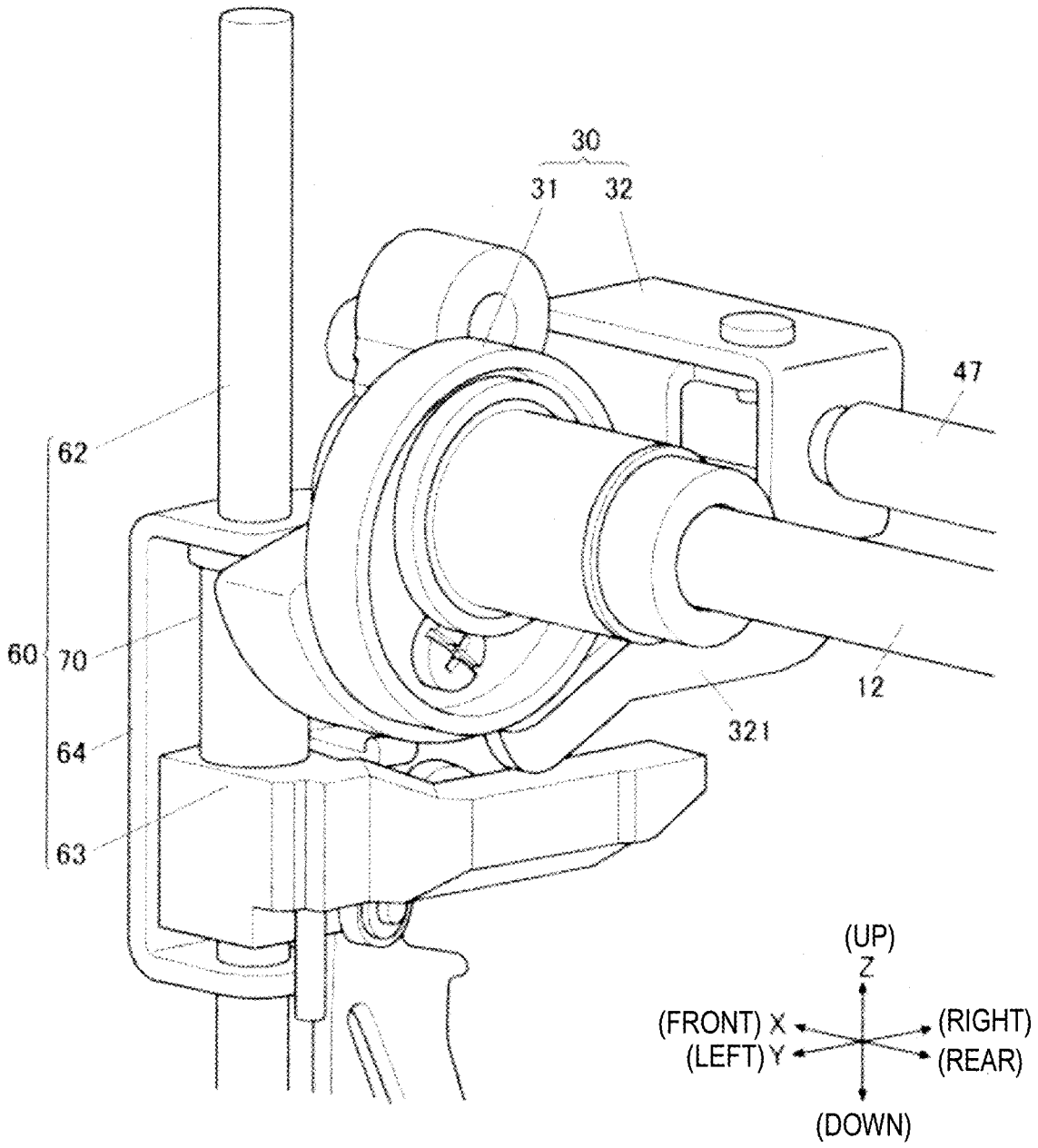
FIG. 8 is a perspective view of a partial configuration of an upper feed vertical motion mechanism.

FIG. 8 is a perspective view of a partial configuration of the upper feed vertical motion mechanism 30.

As illustrated in FIGS. 4, 5, and 8, the upper feed vertical motion mechanism 30 includes an eccentric cam 31 provided on the upper shaft 12, upper and lower arms 32 attached to a second transmission shaft 47 of the upper feed horizontal motion mechanism 40 which will be described later to be rotatable, a bell crank-like converting link 33 supported by a feed dog bracket 64, a horizontal connecting link 34 that connects the upper and lower arms 32 and the converting link 33 to each other, and a vertical connecting link 35 that connects the converting link 33 and the above-described slider 24 to each other.

The upper and lower arms 32 extend leftward and include a first sewing machine arm portion 321 that abuts against the outer periphery of the eccentric cam 31 from below and a second sewing machine arm portion 322 that extends downward and is connected to one end portion of the horizontal connecting link 34.

In addition, the upper and lower arms 32 are provided with an elastic body (not illustrated) for imparting the rotation in a direction in which the first arm portion 321 abuts against the eccentric cam 31.

Accordingly, when the upper shaft 12 is rotationally driven, the eccentric cam 31 rotates, the reciprocating rotation motion is input into the first arm portion 321 at the same cycle as that of the upper shaft 12, and the second arm portion 322 simultaneously performs the reciprocating rotation. At this time, the first arm portion 321 vertically rotates, and the second arm portion 322 rotates back and forth.

In the converting link 33, one location among the three points that serve as apexes of a triangle is connected to the other end portion of the horizontal connecting link 34, another one location is connected to the feed dog bracket 64, and the remaining one location is connected to the upper end portion of the vertical connecting link 35. At any locations, the converting link 33 is rotatably connected around the Y-axis.

When the reciprocating motion in the front-rear direction is input from the second arm portion 322 of the upper and lower arms 32 via the horizontal connecting link 34, the converting link 33 converts the reciprocating motion in the up-down direction using the connecting portion with the feed dog bracket 64 as a fulcrum and transmits the reciprocating motion to the vertical connecting link 35.

Accordingly, the reciprocating vertical motion is transmitted to the slider 24 via the vertical connecting link 35, and the reciprocating motion in the up-down direction is imparted to the supporting member 22 and the upper feed dog 21.

(Upper Feed Horizontal Motion Mechanism)

Figure 9:
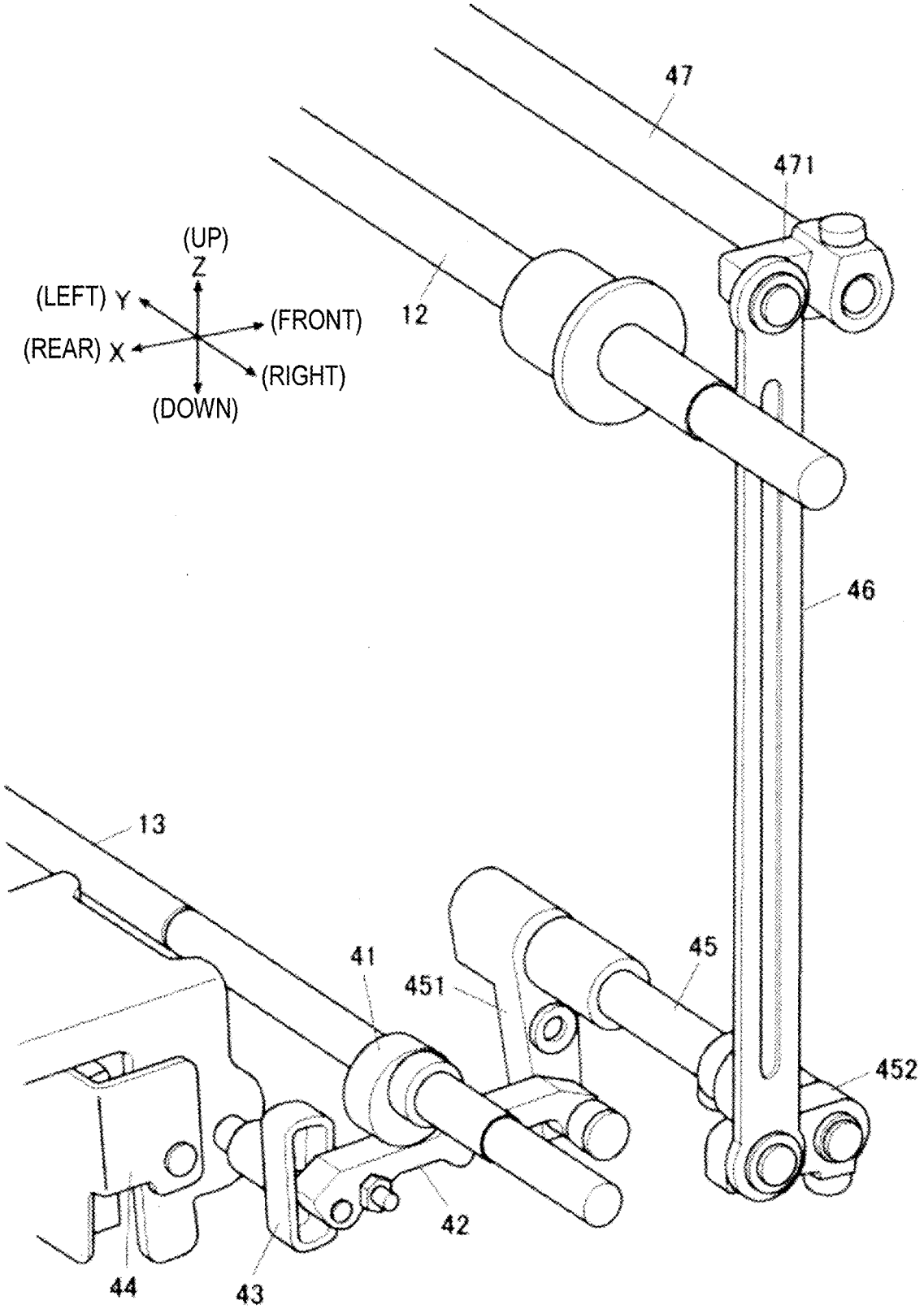
FIG. 9 is a perspective view of an upper feed horizontal motion mechanism.

FIG. 9 is a perspective view of the upper feed horizontal motion mechanism 40.

As illustrated in FIG. 9, the upper feed horizontal motion mechanism 40 includes an eccentric cam 41 provided on the lower shaft 13, a swing base 42 which is in sliding contact with the outer periphery of the eccentric cam 41, an upper feed adjusting body 43 that adjusts a swinging direction of a rear end portion of the swing base 42, an upper feed adjusting motor 44 that rotates the upper feed adjusting body 43, a first transmitting shaft 45 into which the reciprocating rotation is input from a front end portion of the swing base 42, a connecting link 46 to which the reciprocating vertical motion is transmitted from the first transmission shaft 45, the second transmission shaft 47 into which the reciprocating rotation is input from the connecting link 46, a horizontal feeding arm 48 that is rotatably supported by the second transmission shaft 47, and a connecting link 49 that connects the rotating end portion of the horizontal feeding arm 48 and the connecting shaft 227 of the upper end portion of the supporting member 22.

The swing base 42 is disposed along the X-axis direction, and the rear end portion thereof is slidable along a long groove of the upper feed adjusting body 43 and is connected to the upper feed adjusting body 43 in a rotatable manner around Y-axis. In addition, the front end portion of the swing base 42 is connected to an input arm 451 that extends downward from the first transmission shaft 45 in a rotatable manner around Y-axis.

In the swing base 42, an upper surface of the intermediate portion in the X-axis direction is in sliding contact with the outer periphery of the eccentric cam 41, and accordingly, the reciprocating vertical motion is input in synchronization with the rotation of the upper shaft 12 and the lower shaft 13.

Since the front end portion of the swing base 42 is connected to the rotating end portion of the input arm 451 that extends downward from a left end portion of the first transmission shaft 45, the motion of the front end portion of the swing base 42 is restricted in the rotating direction of the input arm 451, that is, in the front-end direction.

Meanwhile, a rear end portion of the swing base 42 can adjust the reciprocating motion direction to any direction along the X-Z plane in accordance with the orientation of the long groove of the upper feed adjusting body 43.

In this case, when the long groove of the upper feed adjusting body 43 is oriented in the Z-axis direction, the front end portion of the swing base 42 does not reciprocate. In addition, when the long groove of the upper feed adjusting body 43 is inclined with respect to the Z-axis direction, the reciprocating motion the swing base 42 reciprocates along the X-axis direction, and in accordance with the inclination angle of the long groove of the upper feed adjusting body 43, the stroke of the reciprocating motion fluctuates.

As the front end portion of the swing base 42 reciprocates along the X-axis direction, the input arm 451 of the first transmission shaft 45 reciprocally rotates. An output arm 452 that extends rearward is fixedly installed in a right end portion of the first transmission shaft 45, and a lower end portion of the connecting link 46 is connected to a rotating end portion of the output arm 452.

Therefore, when the input arm 451 of the first transmission shaft 45 reciprocally rotates, the rotating end portion of the output arm 452 reciprocally and vertically rotates, and the reciprocating vertical motion is transmitted to the connecting link 46.

The upper end portion of the connecting link 46 is connected to the input arm 471 that extends rearward from the right end portion of the second transmission shaft 47. Therefore, the reciprocating rotation motion is input into the second transmission shaft 47 through the connecting link 46 by the reciprocating vertical motion of the connecting link 46.

As illustrated in FIG. 4, a horizontal feed arm 48 that extends downward is fixedly installed in the left end portion of the second transmission shaft 47, and as the reciprocating rotation of the second transmission shaft 47 reciprocatively rotates, a rotating end portion of the horizontal feed arm 48 rotates in the front-rear direction.

Since the rotating end portion of the horizontal feed arm 48 is connected to the connecting shaft 227 of the upper end portion of the supporting member 22 via the connecting link 49, the reciprocating motion in the front-rear direction is input into the upper end portion of the supporting member 22 from the horizontal feed arm 48.

Accordingly, the reciprocating motion along the front-rear direction is input into the upper feed dog 21 held in the feed position of the lower end portion of the supporting member 22.

As described above, by the upper feed vertical motion mechanism 30, the vertical motion synchronized with the rotational speed of the upper shaft 12 is input into the supporting member 22. Meanwhile, by the upper feed horizontal motion mechanism 40, the reciprocating motion in the front-rear direction synchronized with the rotational speed of the lower shaft 13 is input into the supporting member 22. Since the upper shaft 12 and the lower shaft 13 rotate synchronously, the synchronized reciprocating vertical motion and the reciprocating front-rear motion are input into the upper feed dog 21. Therefore, by appropriately adjusting the phases of the reciprocating vertical motion and the reciprocating front-rear motion, it is possible to perform the elliptical motion along the X-Z plane. At this time, by adjusting the phase to circulate in a direction of being oriented rearward in the upper portion of the ellipse and oriented forward in the lower portion, the upper feed dog 21 can be in contact with the workpiece on the throat plate 11 from above and send the workpiece forward.

In addition, the upper feed horizontal motion mechanism 40 can arbitrarily adjust the reciprocating rotation angle of the second transmission shaft 47 by arbitrarily adjusting the inclination angle of the long groove of the upper feed adjusting body 43 with the upper feed adjusting motor 44. Accordingly, it is possible to arbitrarily adjust the stroke of the reciprocating motion in the front-rear direction transmitted to the upper feed dog 21 via each member of the upper feed horizontal motion mechanism 40, and the feed pitch by the upper feed dog 21 can be arbitrarily adjusted.

(Proximity Sensor of Upper Feed Dog)

Figure 11:
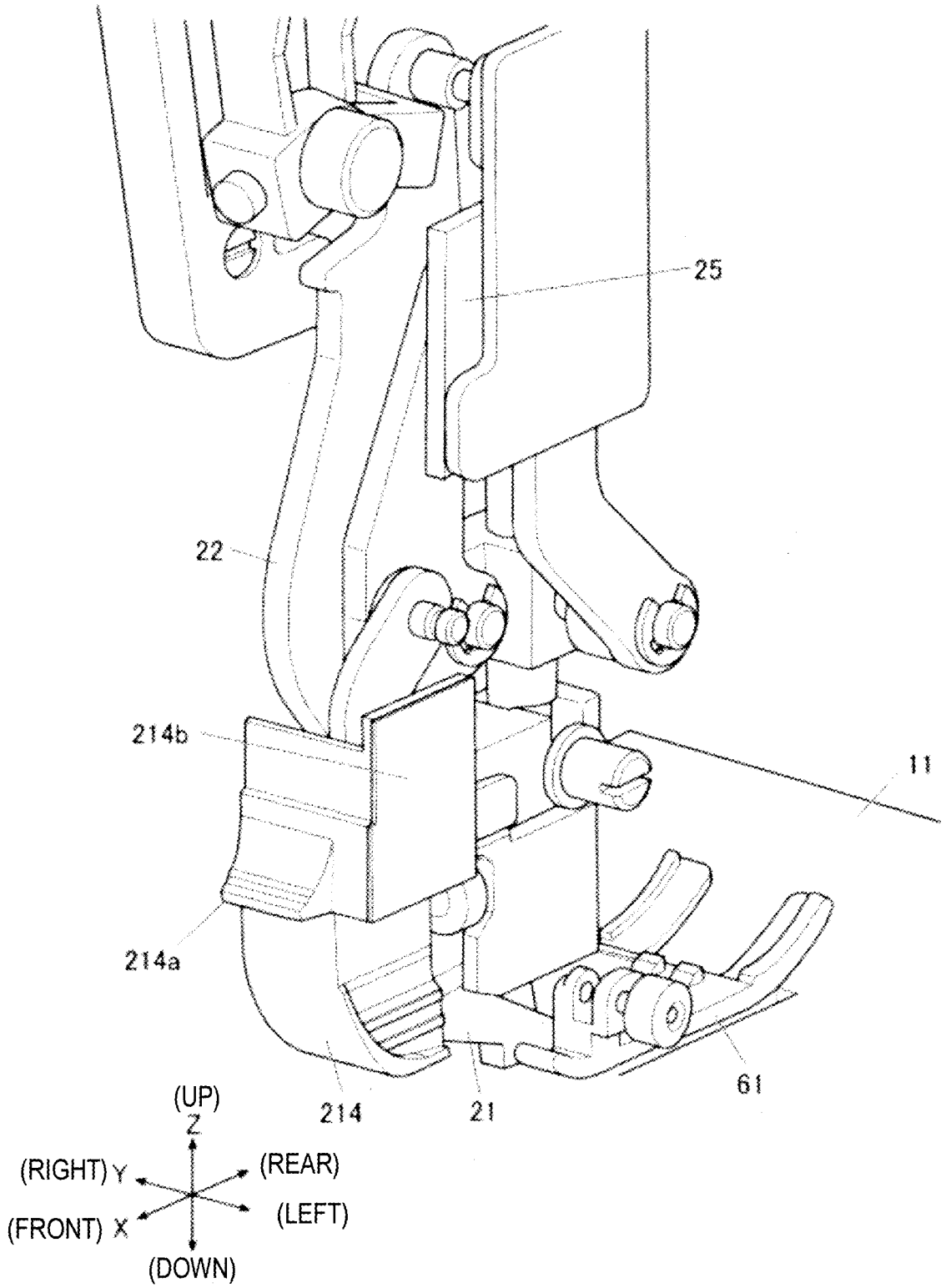
FIG. 11 is a perspective view of the periphery of the presser foot in a case where the upper feed dog is positioned in the feed position.

FIG. 10 is a perspective view of a periphery of the presser foot 61 in a case where the upper feed dog 21 is positioned in the retreat position, and FIG. 11 is a perspective view of the periphery of the presser foot 61 in a case where the upper feed dog 21 is positioned in the feed position.

The upper feed mechanism 20 includes the optical proximity sensor 25 that serves as a detection unit for detecting the downward movement of the upper feed dog 21 from the retreat position.

As illustrated in FIG. 10, in a case where the upper feed dog 21 is positioned in the retreat position, the detected surface **214*b* of the upper feed dog 21 shields the detection unit of the proximity sensor 25, and as illustrated in FIG. 11, when the upper feed dog 21 moves downward toward the feed position, the proximity sensor 25 is supported by the machine frame of the sewing machine 10 (not illustrated) in a disposition in which the detection unit of the proximity sensor 25** is not shielded.

Therefore, when the upper feed dog 21 is manually operated to perform the position switching operation from the retreat position to the feed position, the operation can be detected by the proximity sensor 25 at the start of the downward movement.

A detection signal of the proximity sensor 25 is input into the control device 26 as illustrated in FIG. 1.

In addition, the proximity sensor 25 can use any type of sensor that is capable of detecting the presence of the upper feed dog 21. For example, the presence of the upper feed dog 21 made of a magnetic body may be detected by the proximity sensor that detects magnetism, or the presence of the upper feed dog 21 may be detected by coming into contact with the upper feed dog 21, such as a micro-switch.

(Operation of Sewing Machine)

The sewing machine 10 initially has the upper feed dog 21 in the retreat position and the presence of the upper feed dog 21 is detected by the proximity sensor 25.

In addition, in a case where the sewing is performed with the upper feed using the upper feed dog 21, the upper feed dog 21 is pulled down toward the feed position against the rattling preventing spring 23 by gripping the knob **214*a*** by the manual operation.

When the downward movement of the upper feed dog 21 from the retreat position is started, the position switching of the upper feed dog 21 is detected by the proximity sensor 25 and input into the control device 26.

When a detection signal indicating the absence of the upper feed dog 21 in the retreat position is input from the proximity sensor 25, the control device 26 drives the feed motor 65 of the presser foot mechanism 60 to raise the presser foot 61 from the pressing position to the cloth release position.

By driving the feed motor 65, the left end portion of the presser lifting rod 66 swings upward and the feed dog bracket 64 is pulled up via the long slot 643. At this time, the flat surface portion 642 on the lower side of the feed dog bracket 64 abuts against the bar holder 63, and the presser foot 61 is pulled up to the cloth release position via the presser bar 62.

Accordingly, the upper feed dog 21 can be lowered to the feed position without being interfered by the presser foot 61.

At this time, the connecting pin 213*a* of the upper feed dog 21 moves downward along the long slot 225 of the supporting member 22, and is engaged with the upwardly recessed part 225*a* formed by the bent portion. In addition, the recess portion 211*a* and the projection portion 211*b* of the upper feed dog 21 are engaged with the projection portion 221 and the recess portion 222 of the supporting member 22, and the upper feed dog 21 is held in the feed position in a state of being biased upward by the tension of the rattling preventing spring 23.

(Technical Effects)

The sewing machine 10 includes the control device 26 that controls the feed motor 65 of the presser foot mechanism 60 and pulls up the presser foot 61 to the upper cloth release position when the proximity sensor 25 detects the downward movement from the retreat position of the upper feed dog 21.

Therefore, in a case of setting the upper feed dog 21 to the feed position, it is unnecessary to perform the operation of pulling the presser foot 61 upward in advance; therefore, complication is eliminated, and it is possible to make the position switching operation of the upper feed dog 21 easy to improve operability.

Further, since the upper feed mechanism 20 has a structure in which the rattling preventing spring 23 for pulling the upper feed dog 21 toward the upper retreat position side is provided and the upper feed dog 21 is held in the retreat position by the unevenness structure between the upper feed dog 21 and the supporting member 22, such as the recess portion 211*a*, the projection portion 211*b*, the projection portion 221, and the recess portion 222, when the upper feed dog 21 is pulled down to the feed position against the rattling preventing spring 23, it is possible to hold the upper feed dog 21 by the tension of the rattling preventing spring 23 in the feed position.

Therefore, it becomes possible to perform the switching operation of the upper feed dog 21 to the feed position by a simple operation, and the operability is further improved.

In addition, the supporting member 22 has the long slot 225 that supports the upper feed dog 21 to be vertically movable between the retreat position and the feed position, the long slot 225 is formed in a shape bent in the lower end portion. Therefore, the connecting pin 213*a* of the upper feed dog 21 inserted into the long slot 225 is engaged with the bent part at the lower end portion of the slot 225, and thus, it becomes possible to stably hold the upper feed dog 21 in the feed position in accordance with the engagement between the projection portion 221 and the recess portion 222 described above.

In addition, the supporting member 22 is supported to be vertically movable and the lower end portion of the supporting member 22 is supported to be swingable along the cloth feeding direction, in the sewing machine arm portion. Therefore, the vertical feed motion is input from the upper feed vertical motion mechanism 30 to the supporting member 22 and the reciprocating motion in the front-rear direction is input from the upper feed horizontal motion mechanism 40 to the supporting member 22, and accordingly, it becomes possible to easily realize a circulating movement in the feeding direction of the upper feed dog 21.

In addition, in a case of a structure in which the supporting member 22 is fixed so as not to reciprocate in the up-down, and front-rear direction and the up-down and front-rear reciprocation is input to the upper feed dog 21, a structure in which the upper feed dog 21 can move between the two positions and can reciprocate in the up-down and front-rear direction is necessary, and the support structure of the upper feed dog 21 becomes complicated. Meanwhile, similar to the sewing machine 10, in a case of a structure in which the reciprocating in the up-down and front-rear direction is input to the supporting member that supports the upper feed dog 21 to be switchable between two positions, a structure in which the upper feed dog 21 is supported to be switchable between two positions and the supporting member 22 is supported so as to be capable of reciprocating in the up-down and front-rear direction is achieved, it is possible to divide the support structure into two members, and thus, it becomes possible to make the structure simple while the support structure is not concentrated in one location. Further, along with this, maintenance becomes easy and occurrence of trouble can be reduced.

(Others)

In addition, the proximity sensor 25 that serves as the detection unit may be configured to detect the downward movement from the retreat position from other members interlocking with the upper feed dog 21 instead of directly detecting from the upper feed dog 21.

What is claimed is:

1. A sewing machine comprising:

an upper feed mechanism configured to feed a workpiece on a throat plate from above by an upper feed dog;

a presser foot mechanism including a presser foot for pressing the workpiece on the throat plate from above; and a control device configured to control a driving source of the presser foot mechanism, wherein the upper feed mechanism supports the upper feed dog to be vertically movable between an upper retreat position and a lower feed position, wherein the upper feed mechanism includes a detection unit configured to detect a downward movement of the upper feed dog from the retreat position, and wherein the control device is configured to control the driving source to pull the presser foot upward in response to a detection of the downward movement of the upper feed dog by the detection unit.

2. The sewing machine according to claim 1, wherein the upper feed mechanism includes a supporting member that supports the upper feed dog to be vertically movable between the retreat position and the feed position, and a rattling preventing spring that biases the upper feed dog upward, wherein the supporting member includes a projection portion and a recess portion that engage with a projection portion and a recess portion of the upper feed dog when the upper feed dog moves downward to the feed position, and wherein the engagement of the projection portion and the recess portion of the supporting member with the projection portion and the recess portion of the upper feed dog holds the upper feed dog at the feed position.

3. The sewing machine according to claim 2, wherein the supporting member has an elongated slot that supports the upper feed dog to be vertically movable between the retreat position and the feed position, and wherein the elongated slot is formed in a shape bent at a lower end portion.

4. The sewing machine according to claim 2, wherein the supporting member is supported to be vertically movable, and wherein a lower end portion of the supporting member is supported to be swingable along a cloth feeding direction, in a sewing machine arm portion.

5. The sewing machine according to claim 3, wherein the supporting member is supported to be vertically movable, and wherein a lower end portion of the supporting member is supported to be swingable along a cloth feeding direction, in a sewing machine arm portion.

6. The sewing machine according to claim 1, wherein the detection unit is configured to detect a downward movement of the upper feed dog from the retreat position based on a detected surface of the upper feed dog.

* * * * *